US011394126B1

(12) United States Patent
White et al.

(10) Patent No.: US 11,394,126 B1
(45) Date of Patent: Jul. 19, 2022

(54) DISTRIBUTED MONOPOLE TRANSMITTER

(71) Applicant: HRL Laboratories, LLC, Malibu, CA (US)

(72) Inventors: Carson R. White, Agoura Hills, CA (US); Hyok J. Song, Oak Park, CA (US); Christopher P. Henry, Thousand Oaks, CA (US)

(73) Assignee: HRL LABORATORIES, LLC, Malibu, CA (US)

( * ) Notice: Subject to any disclaimer, the term of this patent is extended or adjusted under 35 U.S.C. 154(b) by 82 days.

(21) Appl. No.: 16/938,369

(22) Filed: Jul. 24, 2020

Related U.S. Application Data

(60) Provisional application No. 62/935,533, filed on Nov. 14, 2019.

(51) Int. Cl.
*H01Q 21/12* (2006.01)
*H01Q 9/16* (2006.01)
*H01Q 9/30* (2006.01)

(52) U.S. Cl.
CPC ..... *H01Q 21/12* (2013.01); *H01Q 9/16* (2013.01); *H01Q 9/30* (2013.01)

(58) Field of Classification Search
CPC ..... H01Q 21/12; H01Q 9/16; H01Q 9/30; H01Q 1/1271; H01Q 1/38; H01Q 9/0407; H01Q 21/28; H01Q 1/48; H01Q 1/325; H01Q 21/065; H01Q 1/3291; H01Q 1/523; H01Q 21/0006; H01Q 3/46; H01Q 1/06; H01Q 15/0026; H01Q 19/005; H01Q 21/0093; H01Q 3/01; H01Q 3/2676; H01Q 21/20; H01Q 3/26; H01Q 21/14; H01Q 15/002; H01Q 13/10; H01Q 15/008; H01Q 5/371; H01Q 5/50; H01Q 13/20; H01Q 15/0066; H01Q 9/0421; H01Q 1/3233; H01Q 1/3275; H01Q 1/36; H01Q 15/142; H01Q 15/148; H01Q 23/00; H01Q 1/32; H01Q 15/14; H01Q 1/28; H01Q 15/141; H01Q 9/045; H01Q 5/335; H01Q 1/1285; H01Q 13/106; H01Q 5/378; H01Q 13/103; H01Q 5/25; H01Q 1/241; H01Q 13/206; H01Q 15/02; H01Q 21/00; H01Q 9/28;
(Continued)

(56) References Cited

U.S. PATENT DOCUMENTS 4,051,479 A * 9/1977 Altshuler ..... H01Q 1/1292 343/703
4,335,469 A 6/1982 Tharp et al.
(Continued)

OTHER PUBLICATIONS

A. D. Watt, VLF Radio Engineering, International Series of Monographs in Electromagnetic Waves, vol. 14, Permagon Press, New York, 1967.

(Continued)

*Primary Examiner* — Andrea Lindgren Baltzell
*Assistant Examiner* — Jesus E Cano
(74) *Attorney, Agent, or Firm* — Ladas & Parry, LLP

(57) ABSTRACT

A distributed transmitter antenna includes a plurality of antenna segments and a plurality of transmitters. A first transmitter of the plurality of transmitters is coupled to a first antenna segment of the plurality of antenna segments, and a second transmitter of the plurality of transmitters is coupled to the first antenna segment and a second antenna segment of the plurality of antenna segments.

25 Claims, 4 Drawing Sheets

(58) Field of Classification Search
CPC .. H01Q 1/34; H01Q 1/42; H01Q 1/50; H01Q 13/18; H01Q 13/28; H01Q 5/321; H01Q 5/357; H01Q 9/0428; H01Q 9/0442; H01Q 9/065; H01Q 1/12; H01Q 15/0013; H01Q 15/0086; H01Q 15/006; H01Q 19/09; H01Q 21/0087; H01Q 25/00; H01Q 3/30; H01Q 5/328; H01Q 9/0485; H01Q 9/40; H01Q 1/2291; H01Q 1/3266; H01Q 11/10; H01Q 19/10; H01Q 21/26; H01Q 3/24; H01Q 3/34; H01Q 5/364; H01Q 1/3283; H01Q 13/085; H01Q 13/203; H01Q 19/30; H01Q 21/0075; H01Q 21/08; H01Q 21/205; H01Q 21/24; H01Q 3/247; H01Q 3/2682; H01Q 5/30; H01Q 5/49; H01Q 21/061; H01Q 21/30; H01Q 9/0414; H01Q 1/084; H01Q 1/2275; H01Q 1/244; H01Q 1/425; H01Q 1/521; H01Q 15/0006; H01Q 21/0037; H01Q 21/22; H01Q 5/314; H01Q 5/385; H01Q 5/392; H01Q 9/0457; H01Q 9/42; H01Q 1/3208; H01Q 1/364; H01Q 15/004; H01Q 19/28; H01Q 21/29; H01Q 5/20; H01Q 9/005; H01Q 19/06; H01Q 15/08; H01Q 15/24; H01Q 21/064; H01Q 19/062; H01Q 21/0031; H01Q 9/14; H01Q 13/02; H01Q 3/2611; H01Q 3/443; H01Q 5/45; H01Q 15/10; H01Q 3/44; H01Q 1/422; H01Q 15/145; H01Q 15/246; H01Q 19/08; H01Q 1/22; H01Q 1/273; H01Q 13/24; H01Q 13/26; H01Q 19/067; H01Q 21/0018; H01Q 21/068; H01Q 5/42; H01Q 1/125; H01Q 1/243; H01Q 1/248; H01Q 1/281; H01Q 1/288; H01Q 1/40; H01Q 1/525; H01Q 13/22; H01Q 15/0046; H01Q 15/147; H01Q 17/00; H01Q 19/104; H01Q 19/32; H01Q 21/0025; H01Q 21/005; H01Q 21/0068; H01Q 21/245; H01Q 25/008; H01Q 3/2658; H01Q 3/28; H01Q 3/36; H01Q 5/47; H01Q 1/2283; H01Q 1/246; H01Q 1/528; H01Q 13/00; H01Q 13/065; H01Q 15/0033; H01Q 15/0053; H01Q 15/0073; H01Q 15/18; H01Q 15/23; H01Q 15/242; H01Q 17/002; H01Q 19/065; H01Q 19/13; H01Q 19/192; H01Q 21/062; H01Q 21/067; H01Q 3/12; H01Q 3/20; H01Q 3/242; H01Q 3/245; H01Q 3/2605; H01Q 3/2617; H01Q 3/2641; H01Q 5/40; H01Q 9/27; H01Q 9/285; H01Q 9/36
See application file for complete search history.

(56) References Cited

U.S. PATENT DOCUMENTS

| | | | | |
|---|---|---|---|---|
| 5,784,031 | A * | 7/1998 | Weiss | H01Q 1/246 342/373 |
| 5,818,385 | A * | 10/1998 | Bartholomew | H01Q 1/246 342/372 |
| 6,229,494 | B1 | 5/2001 | Merenda | |
| 6,236,185 | B1 * | 5/2001 | Hines | H01M 10/42 320/101 |
| 2010/0112943 | A1 * | 5/2010 | Chia | H01Q 3/42 455/41.2 |
| 2018/0076515 | A1 * | 3/2018 | Perlman | H04B 1/40 |
| 2018/0198211 | A1 * | 7/2018 | Wall | H01Q 9/30 |

OTHER PUBLICATIONS

Waveform-synthesis method that reduces battery power in an electrically small wideband radiating system, Merenda,J. T., IET Microwaves, Antennas & propagation(2008),2(1):59.

* cited by examiner

| No. of distributed 1V sources | 1 | 2 | 4 | 8 |
|---|---|---|---|---|
| Tot. Rad Power (nW) @20kHz | 0.103 | 0.263 | 0.943 | 3.36 |

Total Radiated Power (nW)

DISTRIBUTED MONOPOLE TRANSMITTER

CROSS REFERENCE TO RELATED APPLICATIONS

This application is related to and claims the benefit of U.S. Provisional Patent Application No. 62/935,533, filed on Nov. 14, 2019, which is incorporated herein by reference as though set forth in full.

STATEMENT REGARDING FEDERAL FUNDING

This invention was made under U.S. Government contract N66001-19-C-4018. The U.S. Government may have certain rights in this invention.

TECHNICAL FIELD

This disclosure relates to monopole and dipole antennas.

BACKGROUND

A monopole antenna has a wire or mast extending a distance from a ground plane and the wire or mast has a length typically less than one half of a desired wavelength. The antenna is typically driven by a single transmitter at the base of the antenna with one side connected to the ground plane and the other to the wire or mast. For the purpose of this disclosure, a "transmitter" is a subsystem that takes in baseband signals and power and delivers a radio frequency signal to an antenna.

The primary type of electrically small antenna for transmitting low frequencies (e.g. VLF) is a top-loaded monopole fed at the base of the antenna, as described in Reference [1] below, which is incorporated herein by reference. An electrically small antenna is an antenna much shorter than the wavelength of the signal it is intended to transmit or receive. These top loaded monopole antennas tend to be electrically small and may be less than 1/6 of the extremely long signal wavelength in any dimension. This means that the reactive component of the impedance is much larger than the radiation resistance. In most cases, the antenna is resonated with inductance so that high current can be driven on the antenna to achieve sufficient radiated power. For example, for an amplifier that sources approximately 1 kV, the resonance between the tuning inductor and the capacitive antenna may result in 100 kV at the antenna base. This results in 10,000 times more radiated power than if the amplifier were directly connected to an un-resonated antenna. However, resonating the antenna with inductance results in a bandwidth that is just large enough to accommodate today's low-data-rate communications signals, and frequency tuning takes substantial time. A broader bandwidth can be achieved by using a non-resonated antenna; however, the radiated power level may be insufficient for many applications.

The antenna bandwidth and power handling may be increased by increasing the height or size of the top-load, which may be on the scale of 100s of meters in elevation and square kilometers of area. However, this is not compatible with mobile applications.

An alternative is an antenna trailed behind an aircraft. Such an antenna is described in Reference [2] below, U.S. Pat. No. 4,335,469, issued Jun. 15, 1982, which is incorporated herein by reference. However, this type of antenna is not electrically small and requires a large aircraft and the associated operating cost.

Another type of antenna is a waveform synthesis antenna, which directly switches a DC voltage supply in and out of a loop antenna, as described in References [3] and [4] below, which are incorporated herein by reference. A waveform synthesis antenna is a loop which is fundamentally different than a monopole antenna. Further, this type of antenna has two issues. First, it is a loop antenna, which inherently has poor radiation efficiency. Second, the RF voltage builds up around the loop but the DC voltage is constant around the loop. Therefore, the voltage is held off by RF chokes and is limited by the breakdown of the components to nearby ground potentials, which ultimately limits the power that can be radiated.

In summary, electrically small antennas have been investigated for decades but are limited in power by the voltage handling and voltage breakdown.

REFERENCES

The following references are incorporated herein by reference as though put forth in full.

[1] A. D. Watt, VLF Radio Engineering, International Series of Monographs in Electromagnetic Waves, Vol. 14, Permagon Press, New York, 1967.

[2] U.S. Pat. No. 4,335,469, issued Jun. 15, 1982.

[3] Waveform-synthesis method that reduces battery power in an electrically small wideband radiating system, Merenda, J. T., IET Microwaves, Antennas & propagation (2008), 2(1):59.

[4] U.S. Pat. No. 6,229,494, issued Aug. 21, 2012.

What is needed is an improved electrically small antenna with more instantaneous bandwidth at high power levels. The embodiments of the present disclosure answer these and other needs.

SUMMARY

In a first embodiment disclosed herein, a distributed transmitter antenna comprises a plurality of antenna segments, and a plurality of transmitters, wherein a first transmitter of the plurality of transmitters is coupled to a first antenna segment of the plurality of antenna segments, and wherein a second transmitter of the plurality of transmitters is coupled to the first antenna segment and a second antenna segment of the plurality of antenna segments.

In another embodiment disclosed herein, a method of providing a distributed transmitter antenna comprises providing a plurality of antenna segments, and providing a plurality of transmitters, wherein a first transmitter of the plurality of transmitters is coupled to a first antenna segment of the plurality of antenna segments, and wherein a second transmitter of the plurality of transmitters is coupled to the first antenna segment and a second antenna segment of the plurality of antenna segments.

These and other features and advantages will become further apparent from the detailed description and accompanying figures that follow. In the figures and description, numerals indicate the various features, like numerals referring to like features throughout both the drawings and the description.

BRIEF DESCRIPTION OF THE DRAWINGS

FIG. 2A shows a baseband signal and electrical power connected to the transmitter with electrical wires, FIG. 2B shows a configuration in which data is provided to the transmitter over data bus, which is preferably a wireless link at a frequency different than the transmit frequency and which is converted to baseband by a receiver, and a wirelessly connected power source preferably compressed air that delivers power which is converted to electricity by an energy conversion element, for example a turbine, that converts the power into electrical power, FIG. 2C is similar to FIG. 2A except with the same power conversion used in FIG. 2B, and FIG. 2D shows an another embodiment where energy is collected from the environment, such as by solar cells or wind turbines, and the data is delivered to the transmitter over a wireless link in accordance with the present disclosure.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

The present disclosure describes a monopole antenna with a plurality of distributed transmitters that include electrically-floating transmitters connected along the length/height of the monopole. The transmitters are coordinated to produce a desired radiating current in the monopole. Tuning elements, which may be fixed and/or variable inductors, may optionally be included in the transmitters to provide a resonance condition.

Another aspect of the present disclosure is the delivery of the power and signal to the transmitters. In some examples, power is delivered by conductors using appropriate filtering. In another example, power may be delivered by mechanical means, such as compressed air. In another example, the transmitters may be powered by energy harvesting (e.g. solar or wind). In some embodiments the signal to be transmitted may be delivered to the transmitter via wires or may be delivered by wireless links, such as short-range radio frequency links at a frequency different than the transmit frequency.

The present disclosure describes an electrically-small antenna that can radiate substantially increased bandwidth at higher power levels than prior art antennas. The power handling and bandwidth of prior art VLF antennas is limited by the voltage at the base of the antenna and the quality factor. Therefore, prior art antennas are limited to about 250 kV with about 1% bandwidth.

The present disclosure describes a distributed transmitter antenna that enables N times the voltage on the antenna, where N is the number of transmitters, and enables broad bandwidth compared to wideband solutions that do not resonate the antenna. The feed voltage is dropped across N segments of the antenna, which in turn allows approximately N times the amount of radiating current. As discussed further below, the distributed transmitter antenna of the present disclosure also can provide a radiated power greater than or equal to 0.5 times N^2.

Figures 1A, 1B, 1C, 1D, 1E:
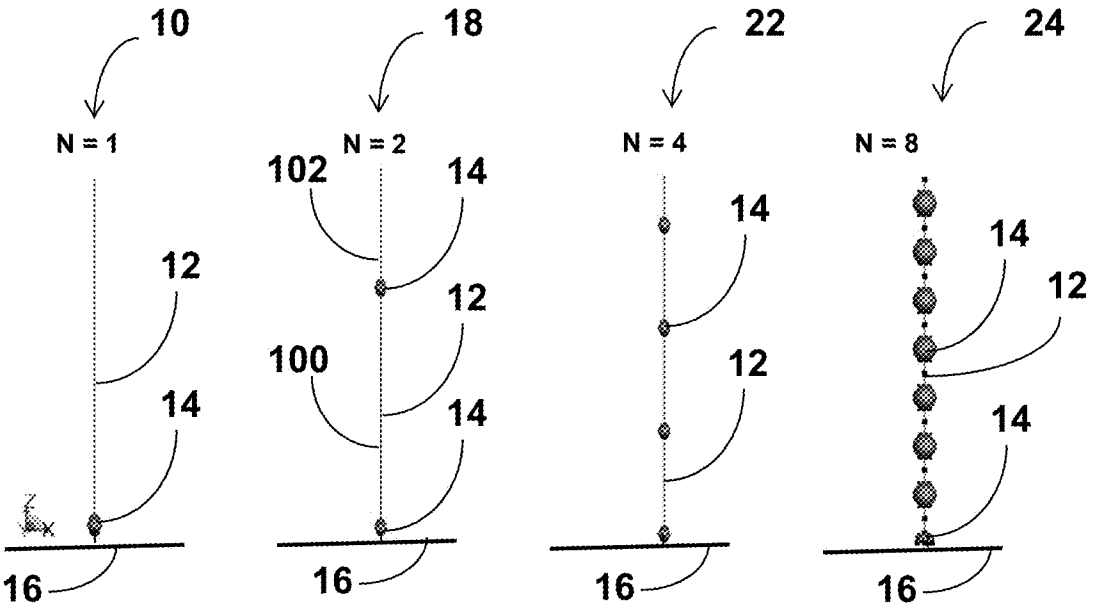
FIGS. 1A, 1B, 1C and 1D show four configurations of an example 100 m monopole antenna having 1, 2, 4 and 8 distributed transmitters, respectively, radiating at 20 kHz.
FIG. 1E shows the radiated power for each of these configurations in accordance with the present disclosure.

FIG. 1A shows a monopole antenna 10 with a mast 12 fed by a single transmitter 14 at its base, which is representative of the prior art. The single transmitter 14 is grounded to ground 16 and connected to the mast 12. The monopole antenna 10 may be, for example, a 100 m monopole antenna radiating at 20 kHz on an essentially infinite ground plane 16. The transmitter 14 in this example drives 1 Volt onto the antenna. The power P radiated is limited by the voltage applied and the large reactance of the antenna, as described by the following equations.

$$P=I^2*R_radiation$$

I=V/X

Therefore P=(V/X)^2*R_radiation where

I is the antenna current,

R_radiation is the radiation resistance,

V is the voltage applied by the transmitter, and

X is the antenna reactance.

At the same time, the 3 dB bandwidth B is given by

B=1/Q=R_total/X where Q is the quality factor defined as a ratio of a resonator's center frequency to its bandwidth, and where R_total=the real part of the input impedance of the antenna.

Therefore the power bandwidth P*B product is proportional to P*B=V^2/X^3*R_radiation*R_total.

FIG. 1B shows a monopole antenna 18 with multiple segments 12 with two transmitters 14 distributed along the length of the antenna 18, which has two antenna segments 12, which are referred to as segments 100 and 102 in FIG. 1B. The bottom transmitter 14 is grounded to ground 16 and connected to segment 100, and the top transmitter 14 may be floating relative to ground 16. Each transmitter 14 transmits a voltage V across its output terminals. Therefore the first antenna segment 12 or lowest segment 100 of the antenna 18 is at potential V and the second antenna segment 12 or segment 102 of the antenna 18 is at 2*V. Assuming each transmitter 14, in the two transmitter example configuration 18 drives V Volts, then the total voltage is 2*V, and one might expect the radiated power to be four times the prior art monopole antenna shown in FIG. 1A; however, a method of moments full-wave simulation has shown that the radiated power is about half that, as further described below. The two transmitter configuration 18 also drives more current onto the antenna, as compared to the prior art configuration 10.

FIG. 1C shows a configuration 22 with 4 transmitters 14 and four antenna segments 12. FIG. 1D shows a configuration 24 with 8 transmitters 14 and eight antenna segments 12. In each of these configurations the bottom transmitter is grounded to ground 16 and the other transmitters may be floating relative to ground 16.

A method of moments full-wave simulation has been performed with the 1, 2, 4 and 8 transmitters 14 as shown in FIGS. 1A, 1B, 1C and 1D, respectively, with each transmitter supplying 1 V on a monopole aluminum wire having a diameter of 0.2 meters. As shown in FIG. 1E, increasing the number of transmitters substantially increases the radiated power by approximately 0.5*N^2 for N>1, where N is the number of transmitters 14. For the simulated examples, shown in FIG. 1E, increasing the number of transmitters increased the radiated power by greater than 0.5*N^2 for N>1, where N is the number of transmitters.

FIGS. 2A, 2B, 2C and 2D show details of the transmitter 14 in accordance with the present disclosure. Each transmitter has a positive 30 and negative 32 output terminal that connects to the antenna as shown, for example, in FIG. 3. Each transmitter 14 has RF drive electronics 34 that convert a low power baseband signal 40 or 36 into a high power radio frequency signal. The RF drive electronics 34 may include tuning elements, which may be fixed and/or variable inductors, to provide a resonance condition. The baseband signal may be modulated or encoded on an RF waveform. In one example, the RF drive electronics 34 includes an oscillator, a modulator and a power amplifier. However, alternative architectures are possible.

It is important that the radio frequency waveform for each respective transmitter 14 be synchronized with the radio frequency waveform for each other transmitter 14, preferably in phase. One way to synchronize the waveforms is by using precision clock in each transmitter 14 or by providing time from an external precision clock to each transmitter. Another way is to synchronize the transmitters 14 is to synchronize each transmitter to a feature in the baseband signal 40 or 36, sent over a wired connection 40 or a wireless link 36, as shown in FIGS. 2A, 2B, 2C and 2D.

If some beam steering is desired then the transmission from each transmitter may be phased to accomplish the beam steering.

Figure 2A:
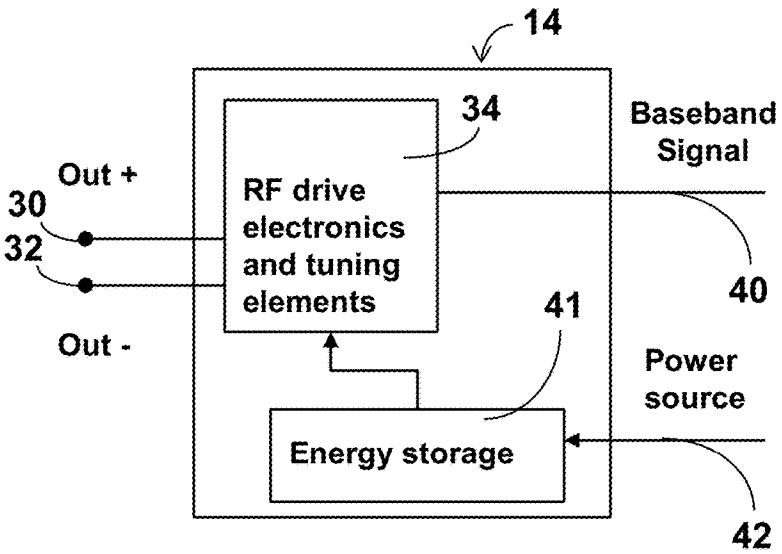
FIGS. 2A, 2B, 2C and 2D show four examples of a transmitter in accordance with the present disclosure.

In FIG. 2A a baseband signal 40 and electrical power 42 are provided by means of electrical wires or conductors connected to the transmitter 14. The energy storage 41 preferably includes capacitors and/or batteries. In this embodiment, the conductors 42 and 40 delivering power and the baseband signal, respectively, may be isolated from the radiating field by means of filters, such as inductive elements, to prevent scattering and unwanted feedback.

Figure 2B:
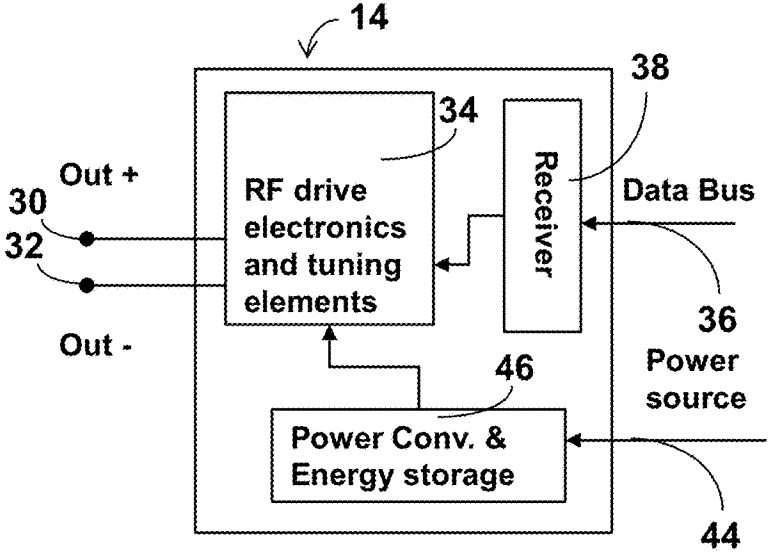

In FIG. 2B, the data to be transmitted is delivered to the transmitter 14 by a wireless data link 36, which uses frequency that is different than the transmit frequency. The data link 36 may also be an optical fiber to achieve isolation from the transmitter. The data link 36 may use, for example, IEEE 802.11, Zigbee, Bluetooth, or frequency modulation, and so on. The data to be transmitted may be converted to the desired baseband by receiver 38. A wireless power source 44, which may be preferably compressed air, can be used to deliver power to the transmitter 14, and an energy conversion component 46, for example a turbine, can be used to convert the power into electrical power. This embodiment has the advantage that the transmitters 14 can easily be at a floating potential relative to ground 16, making it practical to increase the voltage well above that which is possible in the prior art. The power source 44 may also be a combustible fluid with the energy conversion being, for example, an electrical generator.

Figure 2C:
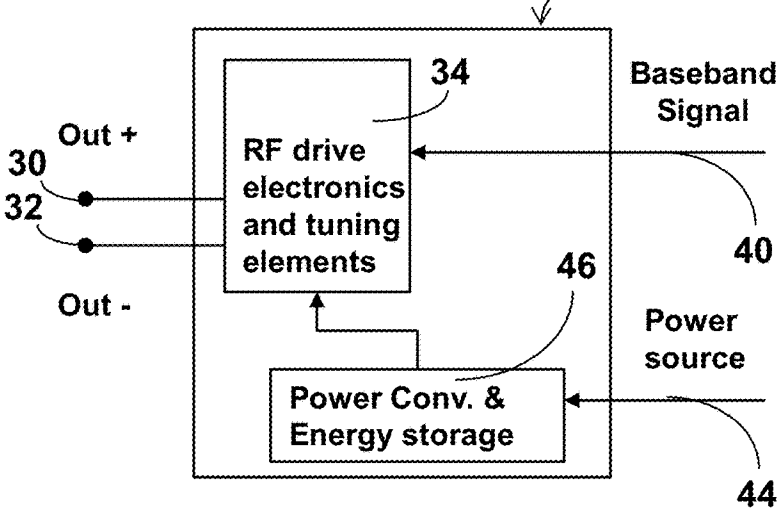

FIG. 2C is an example configuration similar to FIG. 2A for the baseband signal 40 and similar to FIG. 2B for the power source 44 and power conversion and energy storage 46.

Figure 2D:
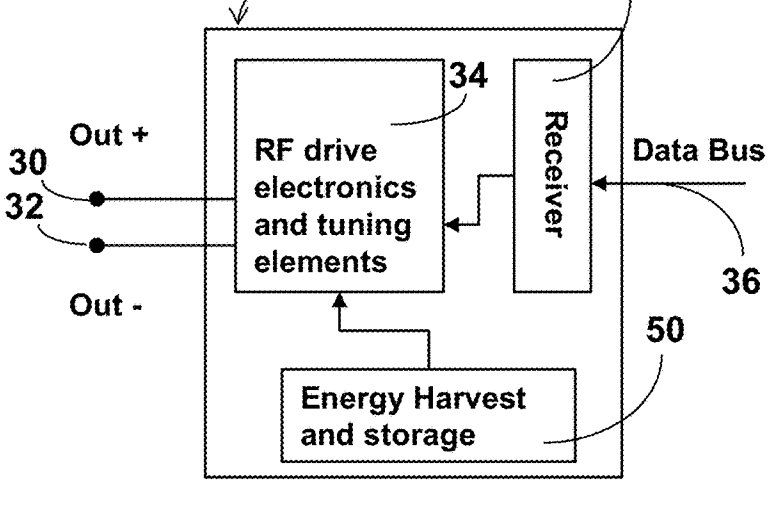

FIG. 2D shows an embodiment where energy 50 is collected from the environment, rather than directly delivered to the transmitter. The energy collection may be by solar cells, wind turbines, or any other method known in the art. The configuration of FIG. 2D also shows the use of a data bus 36, which may be a wireless data link or an optical fiber.

Figure 3:
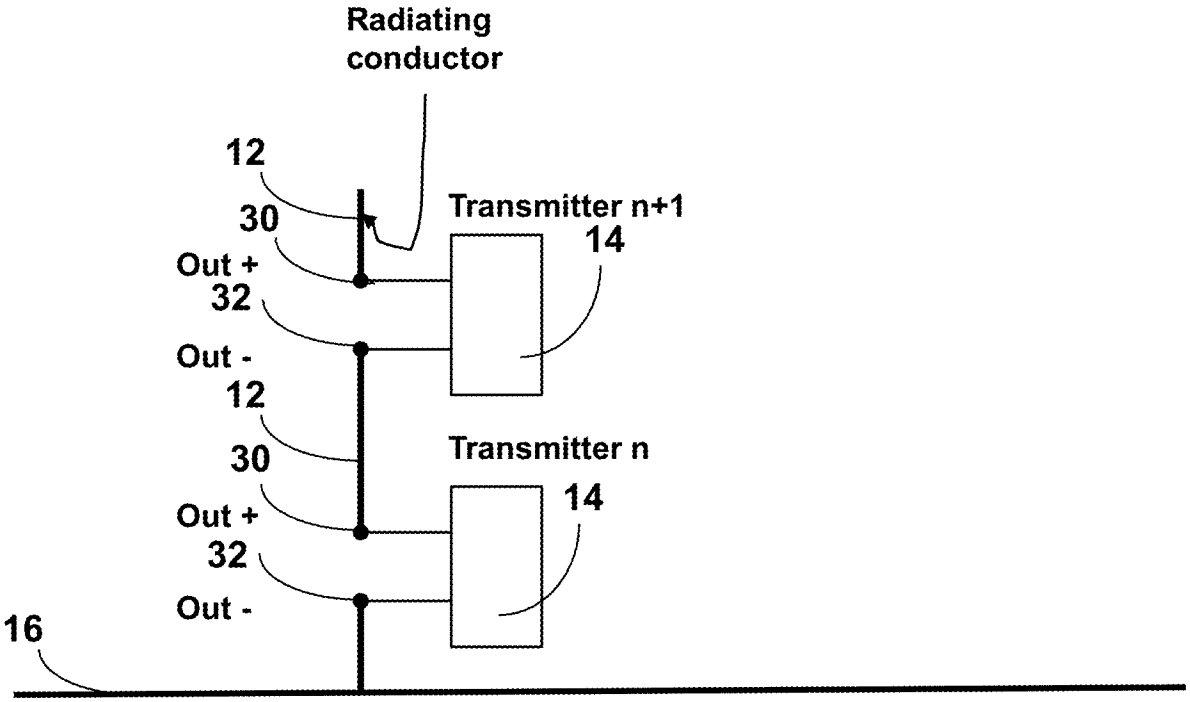
FIG. 3 shows connections of two distributed transmitters to the monopole or dipole antenna in accordance with the present disclosure.

FIG. 3 shows the connection of two transmitters 14 to the monopole or dipole antenna. Each transmitter 14 has a positive 30 and a negative 32 output terminal that connects to the antenna 12. As shown, the bottom transmitter 14 is grounded to ground 16.

Figure 4:
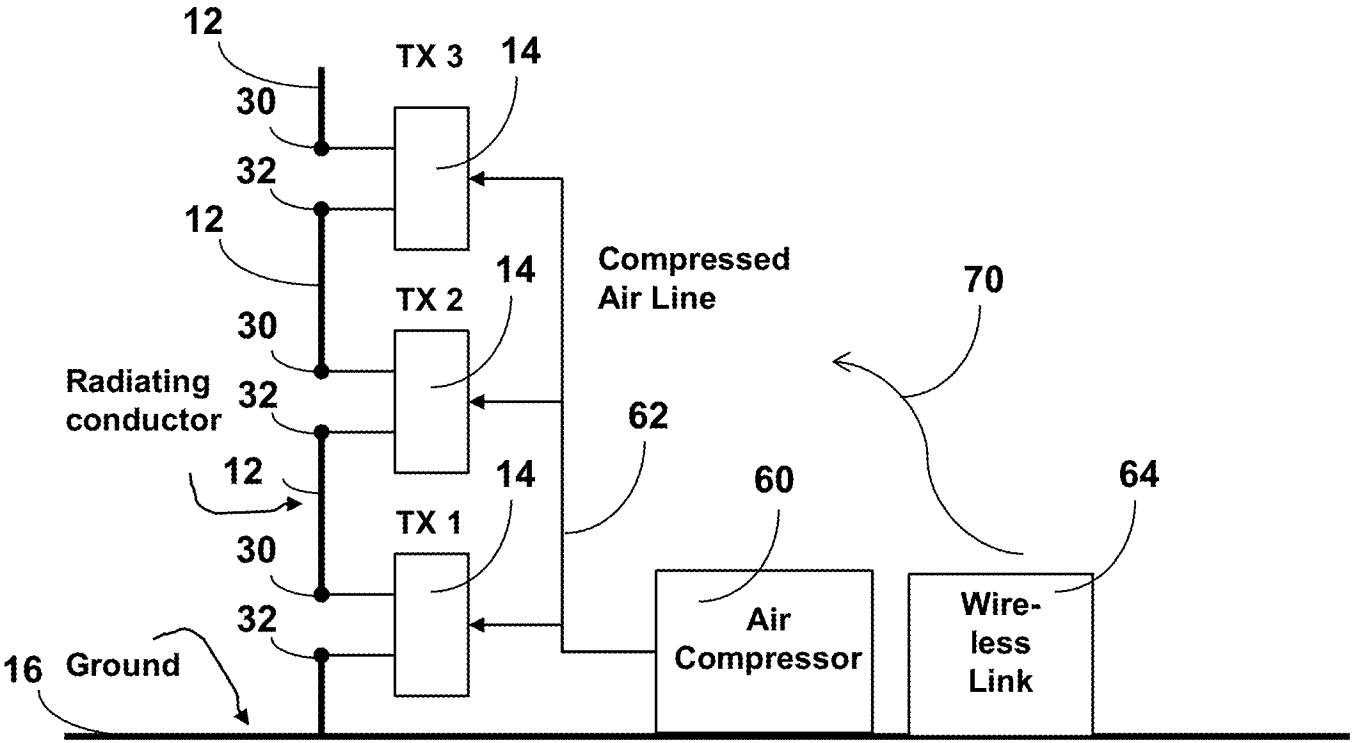
FIG. 4 shows an example embodiment showing three transmitters powered by compressed air with data delivered to the transmitter by a wireless link in accordance with the present disclosure.

A preferred embodiment is shown in FIG. 4, which has transmitters 14 in the configuration shown in FIG. 2B. Shown are three transmitters 14 with power delivered by an air compressor 60, which is electrically insulated from the transmitters 14 by a compressed air line 62, which may be an ABS pipe, a Polyethylene pipe, a rubber hose, and so on. In FIG. 4 data 70 is delivered to the transmitters 14 wirelessly over from a wireless link 64.

In this example, each transmitter 14 creates a potential difference V across transmitter outputs 30 and 32. Therefore the top of the antenna has a voltage of 3*V. Since the connections to the transmitters are wireless and floating relative to ground, each transmitter 14 may also be floating relative to ground and only needs to withstand and supply voltages on the order of V. In FIG. 4, only the bottom transmitter 14 is connected to ground 16.

If N transmitters 14 are used, the voltage applied to the antenna is increased by a factor of N without relying on a narrowband resonance, so the system may have wide bandwidth. As discussed above, the radiated power from the antenna is approximately or greater than 0.5*N^2, where N is the number of transmitters. For 3 transmitters the voltage driven on the antenna is increased by 3 times, and the radiated power is greater than 0.5 times 9 over a prior art antenna as shown in FIG. 1A.

Existing techniques may be used to erect the monopole and dipole antennas with the distributed transmitters 14, as shown in FIGS. 1B, 1C and 1D. One of ordinary skill in the art will recognize that the support structure must be designed to stand off a larger voltage, which may mean using longer insulators to connect to guy wires or using non-conductive materials for the guy wires, such as glass fiber, nylon, and so on.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A distributed transmitter antenna comprising: a plurality of antenna segments; and a plurality of transmitters;

wherein a first transmitter of the plurality of transmitters is coupled to a first antenna segment of the plurality of antenna segments;

wherein a second transmitter of the plurality of transmitters is coupled to the first antenna segment and to a second antenna segment of the plurality of antenna segments; and wherein the first transmitter, the second transmitter, the first antenna segment, and the second antenna segment are coupled in series.

2. The distributed transmitter antenna of claim 1:

wherein the first transmitter is connected to a ground; and wherein the second transmitter is floating relative to the ground.

3. The distributed transmitter antenna of claim 1:

wherein each antenna segment of the plurality of antenna segments is a linear segment; and the plurality of antenna segments is arranged in a nearly straight line.

4. The distributed transmitter antenna of claim 1:

wherein the plurality of antenna segments form a single monopole antenna or a single dipole antenna.

5. The distributed transmitter antenna of claim 1:

wherein the second antenna segment is coupled to a third transmitter of the plurality of transmitters; and the third transmitter is coupled to a third antenna segment of the plurality of antenna segments.

6. The distributed transmitter antenna of claim 1 further comprising:

a power source for the plurality of transmitters;

wherein the power source is wired to each transmitter of the plurality of transmitters; and wherein the power source comprises an electrical generator, solar cells or a wind turbine.

7. The distributed transmitter antenna of claim 1:

wherein each respective transmitter of the plurality of transmitters comprises a power source for the respective transmitter;

wherein the power source comprises an electrical generator, solar cells or a wind turbine.

8. The distributed transmitter antenna of claim 1 further comprising:

a power source for the plurality of transmitters;

wherein the power source is wirelessly coupled to each transmitter of the plurality of transmitters;

and wherein the power source is insulated from each transmitter of the plurality of transmitters.

9. The distributed transmitter antenna of claim 8: wherein the power source comprises an air compressor; and wherein an air hose is coupled between the air compressor and the plurality of transmitters.

10. The distributed transmitter antenna of claim 1 further comprising:

a data bus for providing a baseband signal to be transmitted by the plurality of transmitters;

wherein the data bus is wired to each of the plurality of transmitters; or wherein the data bus comprises a wireless link for transmitting data to the plurality of transmitters; and wherein each of the plurality of transmitters further comprises a receiver for receiving data from the wireless link.

11. The distributed transmitter antenna of claim 1 wherein each transmitter of the plurality of transmitters comprises:

a radio frequency amplifier coupled to a data input;

and an energy storage element comprising a battery or capacitors.

12. The distributed transmitter antenna of claim 11 wherein the radio frequency amplifier further comprises:

a tuning element for providing resonance to an antenna segment of the plurality of antenna segments.

13. The distributed transmitter antenna of claim 1 wherein: each transmitter of the plurality of transmitters transmits a same voltage V;

wherein a voltage supplied to the distributed transmitter antenna is N times V, where N is the number of transmitters in the plurality of transmitters.

14. The distributed transmitter antenna of claim 1 wherein:

each transmitter of the plurality of transmitters transmits a same voltage V;

wherein a radiated power from the distributed transmitter antenna is increased by greater than 0.5*N^2 for N>1, where N is the number of transmitters, compared to a monopole antenna with one transmitter.

15. The distributed transmitter antenna of claim 1: wherein a transmission from each transmitter of the plurality of transmitters is synchronized in phase.

16. The distributed transmitter antenna of claim 15: wherein each transmitter of the plurality of transmitters is synchronized by using time from a precision clock in each transmitter or time from a precision clock external to the plurality of transmitters; or wherein each transmitter of the plurality of transmitters is synchronized to a feature in a baseband signal sent to each of the plurality of transmitters to transmit.

17. A method of providing a distributed transmitter antenna comprising:

providing a plurality of antenna segments; and providing a plurality of transmitters;

wherein a first transmitter of the plurality of transmitters is coupled to a first antenna segment of the plurality of antenna segments;

wherein a second transmitter of the plurality of transmitters is coupled to the first antenna segment and a second antenna segment of the plurality of antenna segments; and wherein the first transmitter, the second transmitter, the first antenna segment, and the second antenna segment are coupled in series.

18. The method of claim 17:

wherein the first transmitter is connected to a ground; and wherein the second transmitter is floating relative to the ground.

19. The method of claim 17 further comprising: providing a tuning element in at least one of the plurality of transmitters for providing resonance to an antenna segment of the plurality of antenna segments.

20. The method of claim 17:

wherein each of the plurality of transmitters transmits a same voltage V;

wherein a voltage supplied to the distributed transmitter antenna is N times V, where N is the number of transmitters in the plurality of transmitters.

21. The method of claim 17:

wherein each transmitter of the plurality of transmitters transmits a same voltage V;

wherein a radiated power from the distributed transmitter antenna is increased by greater than 0.5*N^2 for N>1, where N is the number of transmitters, compared to a monopole antenna with one transmitter.

22. The method of claim 17 wherein a transmission from each transmitter of the plurality of transmitters is synchronized in phase.

23. The method of claim 22:

wherein each transmitter of the plurality of transmitters is synchronized by using time from a precision clock in each transmitter or time from a precision clock external to the plurality of transmitters; or wherein each transmitter of the plurality of transmitters is synchronized to a feature in a baseband signal sent to each of the plurality of transmitters to transmit.

24. The distributed transmitter antenna of claim 1, wherein the antenna has a length that is less than one half of a desired wavelength.

25. The distributed transmitter antenna of claim 1, wherein the plurality of transmitters consists of N transmitters, where N is an integer, and wherein the plurality of antenna segments consists of N+1 antenna segments.

* * * * *